US010294093B1

(12) United States Patent
Volftsun et al.

(10) Patent No.: US 10,294,093 B1
(45) Date of Patent: May 21, 2019

(54) TOUCHLESS TAP HANDLE FOR BEVERAGE DISPENSING

(71) Applicant: Sestra Systems, Inc., Sterling, VA (US)

(72) Inventors: Lev Volftsun, Sterling, VA (US); Deepak Harathi, Sterling, VA (US)

(73) Assignee: SESTRA SYSTEMS, INC., Sterling, VA (US)

( * ) Notice: Subject to any disclaimer, the term of this patent is extended or adjusted under 35 U.S.C. 154(b) by 0 days.

(21) Appl. No.: 15/869,028

(22) Filed: Jan. 11, 2018

Related U.S. Application Data

(63) Continuation-in-part of application No. 15/487,488, filed on Apr. 14, 2017, now Pat. No. 9,926,181, and a continuation-in-part of application No. 15/424,478, filed on Feb. 3, 2017, now Pat. No. 10,167,183, and a continuation-in-part of application No. 15/331,117, filed on Oct. 21, 2016, and a continuation-in-part of application No. 14/686,820, filed on Apr. 15, 2015, now Pat. No. 10,125,002, and a continuation-in-part of application No. 14/686,597, filed on Apr. 14, 2015, now abandoned.

(60) Provisional application No. 62/023,899, filed on Jul. 13, 2014.

(51) Int. Cl.

| | |
|---|---|
| ***B67D 1/12*** | (2006.01) |
| ***B67D 1/00*** | (2006.01) |
| ***B67D 1/08*** | (2006.01) |

(52) U.S. Cl.
CPC ..... *B67D 1/0881* (2013.01); *B67D 1/0888* (2013.01); *B67D 1/1277* (2013.01); *B67D 2210/00047* (2013.01); *Y10T 137/88054* (2015.04)

(58) Field of Classification Search
CPC .. B67D 1/0082; B67D 1/0081; B67D 1/1281; B67D 2001/0093; Y10T 137/88054
See application file for complete search history.

(56) References Cited

U.S. PATENT DOCUMENTS

| | | | |
|---|---|---|---|
| 3,552,606 A | 1/1971 | Kraft et al. | |
| 3,830,405 A | 8/1974 | Jaeger | |
| 5,381,926 A | 1/1995 | Credle, Jr. et al. | |
| 8,479,955 B2 | 7/2013 | Vesborg et al. | |
| 9,926,181 B1 * | 3/2018 | Volftsun et al. | B67D 1/0081 |
| 2008/0189078 A1 | 8/2008 | Vok et al. | |

(Continued)

FOREIGN PATENT DOCUMENTS

| | | |
|---|---|---|
| GB | 1342285 | 1/1794 |

*Primary Examiner* — Kevin L Lee
(74) *Attorney, Agent, or Firm* — John D Gugliotta

(57) ABSTRACT

A touchless tap handle for beverage dispensing is provided that incorporates a spring and ball check valve within a spigot housing. The spigot housing as a male threaded end for connection to a beverage dispensing line. Between the beverage connection and the check valve is a flow control valve having a detachable control mechanism. A system operator can use the control mechanism to calibrate fluid flow. The control mechanism is further fastened or keyed to allow for removal after modifying system flow parameters. A tap handle extension is further provided that can be threadingly affixed to the spigot housing. The tap handle extension specifically does not control operational parameters, which are intended to be initiated through pushbutton control of a pour control system.

25 Claims, 4 Drawing Sheets

(56) References Cited

U.S. PATENT DOCUMENTS

| | | | |
|---|---|---|---|
| 2008/0202148 | A1 | 8/2008 | Gagliano |
| 2010/0089943 | A1 | 4/2010 | Till |
| 2015/0027665 | A1 | 1/2015 | Cooke |

* cited by examiner

TOUCHLESS TAP HANDLE FOR BEVERAGE DISPENSING

RELATED APPLICATIONS

The present invention is a Continuation of U.S. Ser. No. 15/487,488, filed on Apr. 14, 2017 now U.S. Pat. No. 9,926,181. The present invention is also a Continuation in Part of the Improved System and Method for Beverage Dispensing of U.S. Ser. No. 15/424,478, filed on Feb. 3, 2017 now U.S. Pat. No. 10,167,183 and which was a Continuation in Part of the Beverage Dispensing System of U.S. Ser. No. 15/331,117, filed on Oct. 24, 2016, which was a continuation in part of U.S. Ser. No. 14/686,820 (also filed as PCT/US16/27175), now U.S. Pat. No. 10,125,002 all of which are incorporated by reference as if fully rewritten herein.

BACKGROUND OF THE INVENTION

1. Field of the Invention

The present invention relates generally to an improved operation of the Beverage Dispensing System of the type described, taught or anticipated by or within the Related Applications or their equivalents and, more particularly, to an improved tap handle for use therewith.

2. Background of the Related Art

In the automation of beverage dispensing systems, the metering, tracking, controlling and continuous dispensing of volumes can be achieved in a manner that attempts to maximize throughput and optimize repeatability of beverage dispensing. Attaining such improvements is valuable in many situations, especially in high volume venues where faster and more accurate delivery of concessions both improves financial performance as well as minimizes disruption in the enjoyment of the main entertainment event. In implementing such beverage automation, various problems have been identified that would otherwise not be perceivable. In particular, the use of conventional tap handles has proven to pose operational problems that could lead to inefficiencies.

Traditional "beer taps" are valves or spigots for controlling the release of beer, a carbonated beverage stored under pressure. The taps generally include manually actuated ball valves of a standardized connection, in which a male threaded connection affixes to a beer line and the valving mechanism is controlled by a vertically extended tap handle. Typical tap handles are between 9-13" tall and provided support for brand identifying designs. A typical pour is thereby actuated manually by serve staff, resulting in manually implemented portion control.

In the implementation of non-beer beverages dispensers for wine, mixed cocktails or the like, otherwise conventional tap handles of the type used for beer dispensing have been initially utilized and found lacking. Problems include interference with the automation cycle due to manual actuation or attempted manual actuation during an automated pour cycle. Further, conventional beer taps do not include any check-valve feature to prevent dripping between pours or oxidation of beverage in line. Further still, a need has been found to allow for calibration by system control staff while preventing interference with systems settings, either inadvertently or intentionally, by serve staff, wait staff or others.

Consequently, a need exists for an improved tap dispensing valve system for use with improved systems for and methods of operating beverage dispensing systems having metered, tracked, controlled and continuous dispensing volumes.

SUMMARY OF THE INVENTION

It is a specific object of the present invention to provide an improved dispensing tap valve system for use with method a Beverage Dispensing System of the type described, taught or anticipated by or within the Related Applications.

It is a broad object of the present invention to provide broadly or equivalently an improved touchless dispensing tap that allows for optimal system performance with automated beverage dispensing, metering and tracking systems.

Briefly according to a preferred aspect of the present invention, a touchless tap handle for beverage dispensing is provided that incorporates a spring and ball check valve within a spigot housing. The check valve may be adjustable to provide for differences is opening or closing pressures. The spigot housing as a male threaded end for connection to a beverage dispensing line. Between the beverage connection and the check valve is a flow control valve having a detachable control mechanism. A system operator can use the control mechanism to calibrate fluid flow. The control mechanism may thereby be keyed and can be removed after field installation to prevent bartenders from inadvertently or otherwise modifying system flow parameters. A tap handle extension is further provided that can be threadingly affixed to the spigot housing. The tap handle extension specifically does not control operational parameters, which are intended to be initiated through pushbutton control of a pour control system. While the tap handle extension can provide an overall form factor similar to an otherwise conventional tap spigot and can be used for affixing branded or designed handles, no manual opening or closing of the valve can be initiated form the tap handle extension.

It is an advantage of the present invention to prevent bartender interference with the operation of the flow of beverage during an automated dispensing cycle.

It is another advantage of the present invention to provide a check valve incorporated into a tap spigot. Such an advantage can prevent dripping at the end of a dispense cycle, as well as preventing air contact with any in-line beverage.

It is yet another advantage of the present invention to provide a flow control valve that is made removable, thereby making it available only during services or as otherwise provided by authorized personnel.

Still another advantage of the present flow control valve is to provide a full shutoff of the beverage flow when servicing the system.

Further advantages of the present invention provide improved accuracy and repeatability, and decrease variability of volumes for dispensed beverages during operation of automated pour control systems.

Further objects, features and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

The best mode for carrying out the invention is presented in terms of its preferred embodiment, herein depicted within the Figures.

1. Detailed Description of the Figures

Before explaining the present invention in detail, it is important to understand that the invention is not limited in its application to the details of the construction illustrated and the steps described herein. The proposed systems and methods, in the present enablement of the preferred embodiment, is intended to ensure precision volumetric control of a Beverage Dispensing System of the Related Applications, or the broad equivalent thereof. As will be shown and described herein below, such improved and precise operation of controlling dispensed beverages may be accomplished through anticipatory control of alternating reversing actions of a dispensing piston such as to allow for repeatability and control at various pressures and in the face of operational anomalies that invariably occur in various real world operational theaters. It is to be understood that the phraseology and terminology employed herein is for the purpose of description and not of limitation, and should be broadly construed for the intended purpose.

Figure 1:
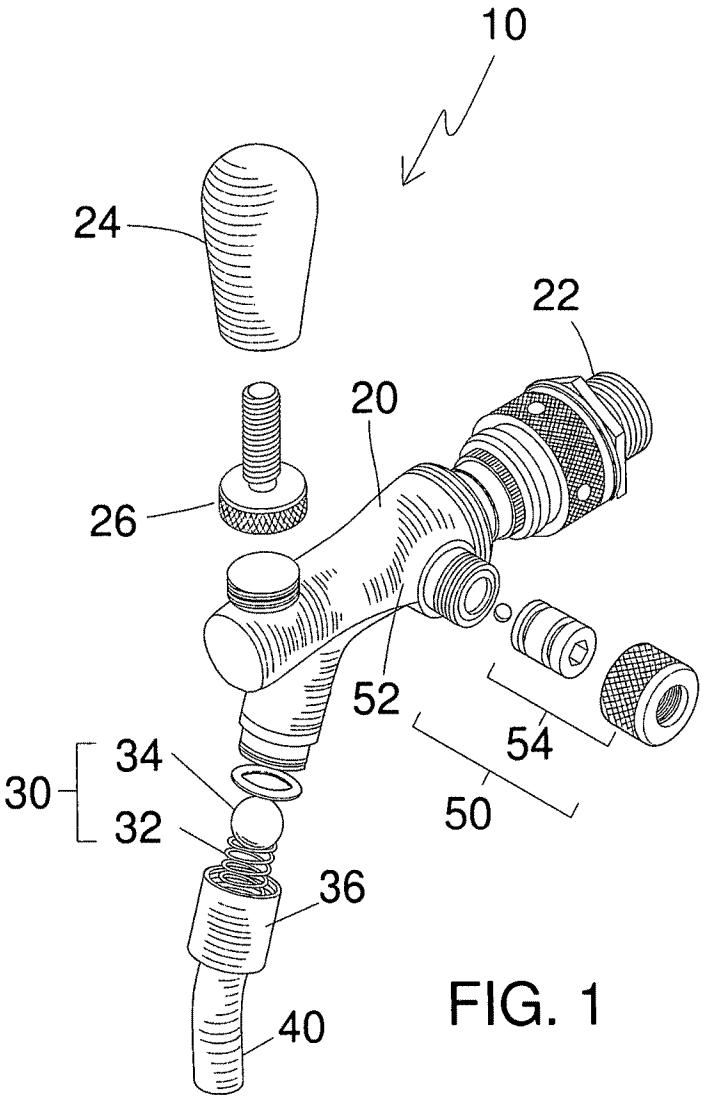
FIG. 1 is a partially exploded perspective schematic view of a touchless tap handle for use with a beverage dispensing and pour control systems according to a preferred embodiment of the present invention.
Figure 2:
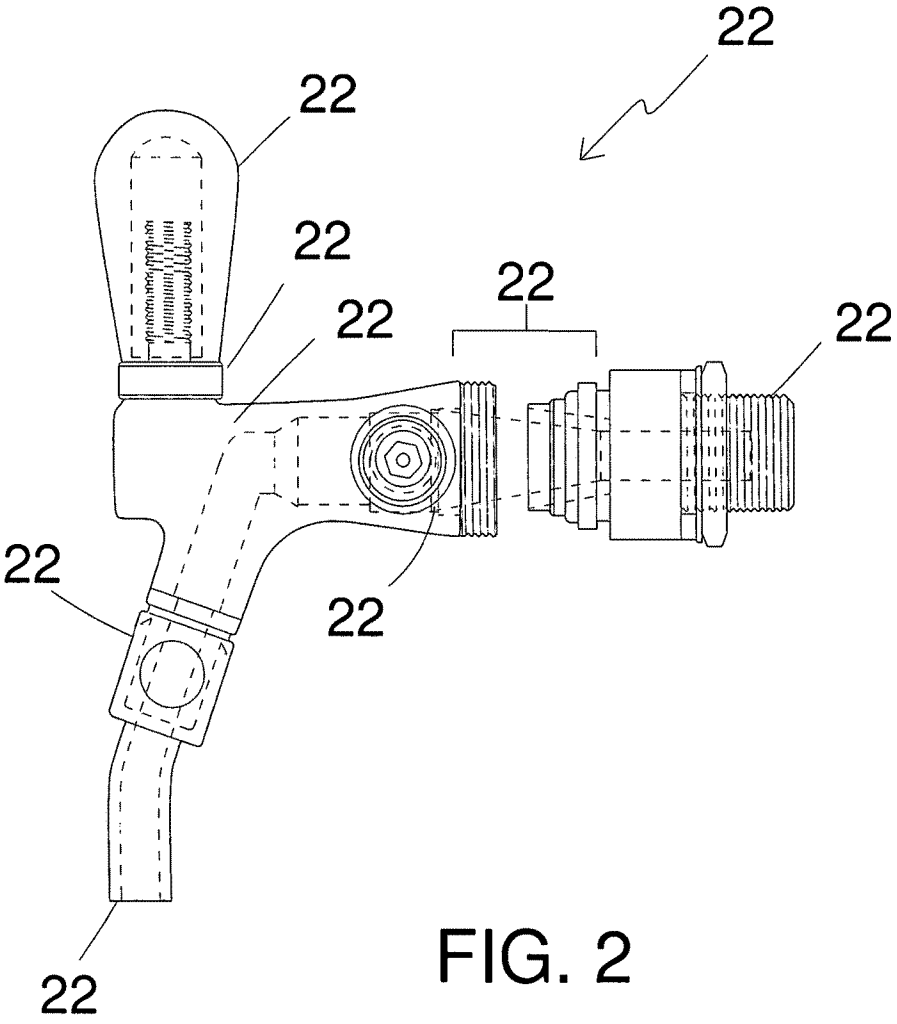
FIG. 2 is a cross sectional side elevational view thereof.
Figure 3:
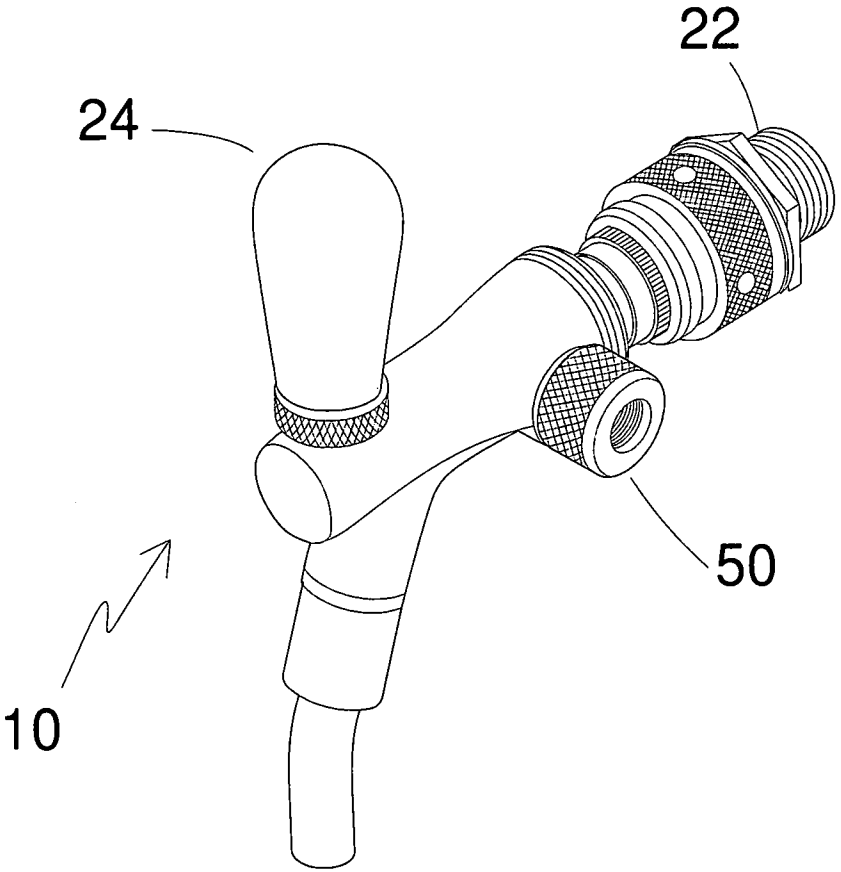
FIG. 3 is a perspective view of the tap handle according to the preferred embodiment of the present invention shown having the handle 24 attached.
Figure 4:
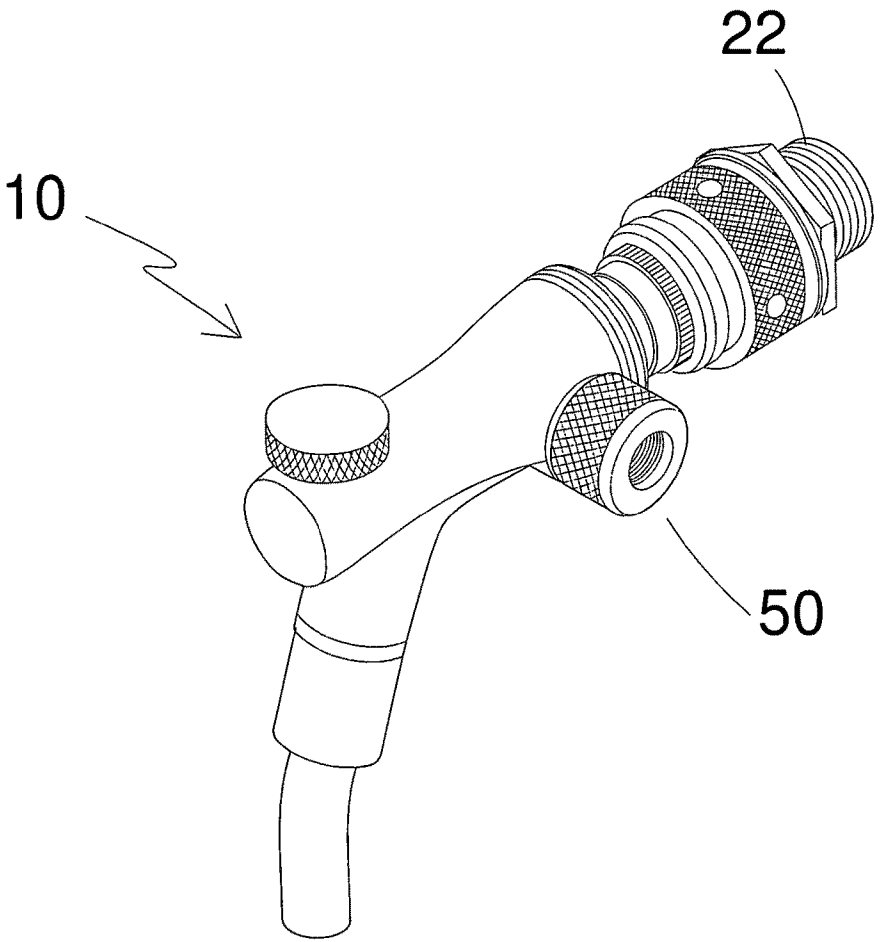
FIG. 4 is a perspective view of the tap handle if FIG. 3 shown having the handle 24 removed.

According to a preferred embodiment of the present invention, a tap spigot system is provided that allows for the realization of efficiency and repeatability off operation in the use of an automated Beverage Dispensing System. Referring now to FIG. 1-4, a touchless tap handle, generally noted as 10, is provided for beverage dispensing. The touchless tap handle 10 includes a spigot housing 20, a check valve mechanism 30, and a discharge spout 40, and a flow control adjustment mechanism 50.

The spigot housing 20 can provide any form factor that emulates existing tap spigots; however, while such a form factor may be preferable it should be apparent that the overall form factor should not be limiting to the features or operation of the present invention. The housing 20 should include a threaded connection 22 to allow for connection with both conventional beverage dispensing systems as well as those Beverage Dispensing System of the type described, taught or anticipated by or within the Related Applications or their equivalents. A tap handle extension 24 is further provided that can be threadingly affixed 26 to the spigot housing 20. The tap handle extension 24 specifically does not control operational parameters, which are intended to be initiated through pushbutton control of a pour control system (not shown). While the tap handle extension 24 may provide an overall form factor similar to an otherwise conventional tap spigot and can be used for affixing branded or designed handles, no manual opening or closing can be initiated from the tap handle extension 24.

The check valve mechanism 30 is provided between the flow control adjustment mechanism 50 and the discharge spout 40. According to one aspect of the present invention, the check valve mechanism 30 may include a spring 32 and ball 34 construction for providing opening or closing at a desired system pressure. According to another aspect of the present invention, the check valve mechanism 30 may be adjustable to provide for differences is opening or closing pressures. One such mechanism for adjusting such operational pressures of the check valve 30 is to provide interchangeable springs 32 with desired spring constants that may be installed within a check valve housing 36.

Between the beverage connection 22 and the check valve housing 36 is the flow control adjustment mechanism 50. The flow control adjustment mechanism 50 may include a valve mechanism 52 having a detachable control mechanism 54. The flow control valve 52 may be used to as a control mechanism to calibrate fluid flow through the discharge spout 40. The detachable control mechanism 54 may be keyed or fastened in a manner as to be capable of removal after field installation. By making the detachable control mechanism 54 removable, bartenders or other staff from inadvertently or otherwise modifying system flow parameters.

According to a functionally equivalent aspect of the present invention, the flow control valve 52 may be provided in the form of a solenoid control valve, or a pneumatic control valve. It has been determined that the use of a solenoid control valve is not operationally compatible when used in conjunction with an automated beverage control system for dispensing of beverages having carbonation, such as beer or sparkling wines, in that the configuration of such valves appear to facilitate a turbulence that makes a dispensed beverage discharge to be commercially unacceptable. As such, the use of solenoid control valves is envisioned to be limited for use with the dispensing of noncarbonated beverages, such as non-sparkling wines, mixed alcoholic or non-alcoholic beverages, flavored waters, energy drinks, or similar or equivalent beverages.

Alternately, the use of a pneumatic control valve variant appears to be acceptable for the automated dispensing of most beverage options. It has been determined that the use of a pneumatic control valves in such an operation would further benefit by using the same pneumatic pressure source that is generally provided to supply the beverage urging force for automated beverage control systems.

In either variant, the control valve may be positioned within said discharge spout in lieu of the spring activated check valve, or may be positioned within the spigot housing 20 in the fluid line prior to the check valve mechanism 30.

2. Operation of the Preferred Embodiment

The present invention is intended to be used in conjunction with an automated beverage dispensing system. More specifically, it is felt that the present invention may be used in conjunction with an improved operation of the Beverage Dispensing System of the type described, taught or anticipated by or within the Related Applications or their equivalents. The use of such an improved tap handle can allow for optimum operation of such a Beverage Dispensing System without interfering with the improvements achieved by such a Beverage Dispensing System, namely, such maximized throughput and optimized efficiency in the implementation of non-beer beverages dispensers for wine, mixed cocktails or the like. Once affixed to a discharge conduit of such a system, the flow control adjustment mechanism 50 is positioned to provide desired fluid flow rates. Similarly, the check valve mechanism 30 may be adjusted to provide for a desired pressure at shutoff. At this point the Beverage Control System can thereby be utilized according to its anticipated functionality without the problems and disadvantages identified by the use of otherwise conventionally available tap spigot mechanisms.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company, v. Hilton Davis Chemical,* 520 US 17 (1997) or *Festo Corp. v. Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A tap configuration for use with an automated beverage control system comprising:

a spigot housing having a fluid line connection opposite a discharge spout, said fluid line connection to allow for connection with a beverage dispensing system;

a flow control adjustment mechanism in fluid communication between said fluid line connection and said discharge spout, said fluid control adjustment mechanism further being in operational communication with an automated beverage control system; and a tap handle extension removably affixed to the spigot housing, wherein said tap handle extension specifically does not control operational parameters of flow through said tap handle configuration.

2. The tap configuration of claim 1, wherein said flow control adjustment mechanism further comprises:

a flow control valve mechanism used to regulate fluid flow rate through the discharge spout; and a detachable control mechanism.

3. The tap configuration of claim 2, wherein said detachable control mechanism comprises a tool keyed control adjuster to or otherwise fastened in a manner as to be capable of removal adjustment of fluid flow rate.

4. The tap configuration of claim 1, wherein said flow control adjustment mechanism comprises a control valve selected from a group consisting of: a pneumatic control valve; and a solenoid control valve.

5. The tap configuration of claim 4, wherein said pneumatic control valve is positioned within said discharge spout.

6. The tap configuration of claim 4, wherein said pneumatic control valve is operationally powered by a pneumatic urging force that is further functionally affecting the automated beverage control system.

7. The tap configuration of claim 5, wherein said pneumatic control valve is operationally powered by a pneumatic urging force that is further functionally affecting the automated beverage control system.

8. The tap configuration of claim 2, wherein said flow control adjustment mechanism comprises a control valve selected from a group consisting of: a pneumatic control valve; and a solenoid control valve.

9. The tap configuration of claim 8, wherein said control valve is positioned within said discharge spout.

10. The tap configuration of claim 8, wherein said pneumatic control valve is operationally powered by a pneumatic urging force that is further functionally affecting the automated beverage control system.

11. The tap configuration of claim 9, wherein said pneumatic control valve is operationally powered by a pneumatic urging force that is further functionally affecting the automated beverage control system.

12. The tap configuration of claim 3, wherein said flow control adjustment mechanism comprises a control valve selected from a group consisting of: a pneumatic control valve; and a solenoid control valve.

13. The tap configuration of claim 12, wherein said control valve is positioned within said discharge spout.

14. The tap configuration of claim 12, wherein said pneumatic control valve is operationally powered by a pneumatic urging force that is further functionally affecting the automated beverage control system.

15. The tap configuration of claim 14, wherein said pneumatic control valve is operationally powered by a pneumatic urging force that is further functionally affecting the automated beverage control system.

16. A tap configuration for use with an automated beverage control system comprising:

a spigot housing having a fluid line connection opposite a discharge spout, said fluid line connection to allow for connection with a beverage dispensing system;

a check valve mechanism in fluid communication with said discharge spout; and a flow control adjustment mechanism in fluid communication between said fluid line connection and said discharge spout, said fluid control adjustment mechanism further being in operational communication with an automated beverage control system.

17. The tap configuration of claim 16, wherein said check valve mechanism is provided between the flow control adjustment mechanism and the discharge spout.

18. The tap configuration of claim 17, wherein said check valve mechanism comprises a spring and ball construction for providing opening or closing at a desired system pressure.

19. The tap configuration of claim 18, wherein said check valve mechanism further comprises interchangeable springs with desired spring constants that may be installed within a check valve housing.

20. The tap configuration of claim 16, wherein said flow control adjustment mechanism further comprises:

a flow control valve mechanism used to regulate fluid flow rate through the discharge spout; and a detachable control mechanism.

21. The tap configuration of claim 20, wherein said detachable control mechanisms comprises a handle that is keyed to or otherwise fastened in a manner as to be capable of removal adjustment of fluid flow rate.

22. The tap configuration of claim 20, wherein said flow control valve mechanism comprises a pneumatic control valve.

23. The tap configuration of claim 22, wherein said pneumatic control valve is positioned between said fluid line connection and said check valve mechanism.

24. The tap configuration of claim 22, wherein said pneumatic control valve is operationally powered by a pneumatic urging force that is further functionally affecting the automated beverage control system.

25. The tap configuration of claim 24, wherein said pneumatic control valve is operationally powered by a pneumatic urging force that is further functionally affecting the automated beverage control system.

* * * * *